US010258861B2

(12) United States Patent
Sierakowski

(10) Patent No.: US 10,258,861 B2
(45) Date of Patent: Apr. 16, 2019

(54) SPORT BOARD BINDING SYSTEM

(71) Applicant: Kendall Sierakowski, LaGrange, KY (US)

(72) Inventor: Kendall Sierakowski, LaGrange, KY (US)

( * ) Notice: Subject to any disclaimer, the term of this patent is extended or adjusted under 35 U.S.C. 154(b) by 0 days.

(21) Appl. No.: 15/613,836

(22) Filed: Jun. 5, 2017

(65) Prior Publication Data

US 2017/0348585 A1 Dec. 7, 2017

Related U.S. Application Data

(60) Provisional application No. 62/345,343, filed on Jun. 3, 2016.

(51) Int. Cl.

| | |
|---|---|
| ***A63C 10/10*** | (2012.01) |
| ***A63C 10/14*** | (2012.01) |
| ***A43B 5/04*** | (2006.01) |
| ***A63C 10/04*** | (2012.01) |
| *A63C 10/18* | (2012.01) |

(52) U.S. Cl.

CPC ..... *A63C 10/10* (2013.01); *A43B 5/0403* (2013.01); *A63C 10/04* (2013.01); *A63C 10/14* (2013.01); *A63C 10/18* (2013.01)

(58) Field of Classification Search

CPC ..... A63C 10/18; A63C 10/00; A63C 10/10; A63C 10/103; A63C 10/106; A63C 9/086; A45B 5/043; A45B 5/0421; B62M 3/086; E05B 55/005

See application file for complete search history.

(56) References Cited

U.S. PATENT DOCUMENTS

| | | | | |
|---|---|---|---|---|
| 3,727,932 A * | 4/1973 | Druss | A63C 9/08 | 280/613 |
| 3,899,190 A * | 8/1975 | Schweizer | A43B 5/0417 | 280/613 |
| 3,902,729 A * | 9/1975 | Druss | A63C 9/086 | 280/613 |
| 4,185,851 A * | 1/1980 | Salomon | A43B 5/0421 | 280/613 |
| 4,196,920 A * | 4/1980 | Salomon | A63C 9/081 | 280/613 |

(Continued)

OTHER PUBLICATIONS

Written Opinion of the International Searching Authority, International Application No. PCT/US2017/35940, International Filing Date: Jun. 5, 2017, 7 pages.

(Continued)

*Primary Examiner* — Emma K Frick

(74) *Attorney, Agent, or Firm* — James R Hayne; Stites & Harbisoon, PLLC

(57) ABSTRACT

A sport board binding system includes a receiver configured to be secured to a deck of a sport board, a boot, and an intermediate locking member. The receiver defines a channel extending inward from a periphery of the receiver. The boot is configured to be worn by a user and includes an engagement mechanism. The intermediate locking member includes a lower head connected to an upper head by way of a neck with the lower head selectively housed within the channel of the receiver and the upper head selectively housed within the engagement mechanism of the boot.

16 Claims, 10 Drawing Sheets

(56) References Cited

U.S. PATENT DOCUMENTS 4,278,269 A * 7/1981 Beyl ..... A63C 9/086 280/605
4,298,210 A * 11/1981 Lotteau ..... A43B 5/14 280/11.3
5,046,382 A * 9/1991 Steinberg ..... B62M 3/086 36/131
5,641,172 A * 6/1997 Hoffman ..... A63C 17/01 280/11.3
5,906,388 A * 5/1999 Neiley ..... A43B 5/0401 280/14.22
6,015,161 A * 1/2000 Carlson ..... A63C 5/128 280/626
6,022,040 A * 2/2000 Buzbee ..... A63C 10/10 280/607
6,196,569 B1 * 3/2001 Berger ..... A63C 10/10 280/14.21
6,270,089 B1 * 8/2001 Marechal ..... A63C 9/086 280/11.221
6,299,192 B1 * 10/2001 Bryce ..... A63C 9/086 280/14.22
6,331,007 B1 * 12/2001 Bryce ..... A43B 5/00 280/11.3
6,336,650 B1 * 1/2002 Alspaugh ..... A63C 10/10 280/613
6,354,610 B1 3/2002 Dodge
6,557,866 B2 * 5/2003 Jones ..... A63C 10/10 280/14.22
6,729,629 B2 * 5/2004 Chi ..... A43B 5/1633 280/11.27
6,742,801 B1 6/2004 Dodge
6,773,024 B2 * 8/2004 Walkhoff ..... A63C 7/1053 280/613
6,855,023 B2 * 2/2005 Berger ..... A63C 10/10 280/607
7,300,070 B2 * 11/2007 Pelchat ..... A63C 5/128 280/14.24
7,334,810 B2 * 2/2008 Holzer ..... A63C 5/128 280/14.24
7,918,477 B2 * 4/2011 Wischhusen ..... A63C 10/145 280/613
8,371,591 B2 * 2/2013 Hwongbo ..... A63C 10/18 280/14.24
8,827,280 B2 * 9/2014 Krenn ..... A63C 10/04 280/11.33
2001/0010422 A1 * 8/2001 Merino ..... A43B 5/0403 280/624
2004/0017064 A1 * 1/2004 Brown ..... A63C 9/02 280/629
2004/0150194 A1 8/2004 Okajima
2010/0154254 A1 * 6/2010 Fletcher ..... A43B 5/0403 36/117.1
2016/0347434 A1 * 12/2016 Mano ..... B63H 16/02
2017/0360291 A1 * 12/2017 Chegini ..... A61B 1/3135

OTHER PUBLICATIONS

International Search Report, International Application No. PCT/US2017/35940, International Filing Date: Jun. 5, 2017, 6 pages.
McLean, Andrew, "Portable Emergency Sled for Backcountry Skiing" StraightChuter.com, Apr. 27, 2016, 7 pages, http://www.straightchuter.com/portable-emergency-sled-for-backcountry-skiing/.

* cited by examiner

SPORT BOARD BINDING SYSTEM

CROSS-REFERENCE TO RELATED APPLICATIONS

The present application claims priority to U.S. Provisional Patent Application Ser. No. 62/345,343 filed on Jun. 3, 2016, the entire disclosures of which are incorporated herein by reference.

TECHNICAL FIELD

The present invention relates to binding systems for sport boards, such as land sport boards (i.e., snowboards, mountainboards, sandboards, etc.), water sport boards (i.e., wakeboards, kiteboards, sailboards, etc.), and sky sport boards (i.e., skysurfing boards, etc.), and the like. More specifically, the present invention relates to a system for partially and removably securing a user's foot to a deck of a sport board.

BACKGROUND OF THE INVENTION

A typical sport board assembly, for example a snowboard assembly, includes a snowboard and a snowboard binding assembly for each foot that is attached to the top surface of the snowboard that binds a rider's feet to the snowboard in one fixed position. One disadvantage of this typical snowboard binding systems lack of movement of the boot once the binding is engaged. In order to adjust the position, or orientation, of the rider's feet in relation to the snowboard, the binding equipment must be adjusted into a different setting. This adjustments typically take as much as twenty minutes and requires specific tools.

Another issue with typical snowboard bindings is that riders have difficulty when loading/unloading at chairlifts. Specifically, typical snowboard bindings limit the ability to quickly and easily remove the rider's boot from the board to push the rider across flat surfaces. Typically, in such instances, a snowboarder must first come to a stop, release one or more of the bindings, perform an action (e.g., loading/unloading from a chairlift), stop to rebind the boot, and only then start moving again. Furthermore, a rider typically will sit down in the snow to release and/or rebind the boot which requires the rider to then make an effort to get back up into a riding position.

Furthermore, due to the fixed position of the rider's feet, problems with the knee, known as "torqued knee" and problems with ankles are typical in this sport. "Torqued knee" comes from pushing the board with the back foot once unbound from the binding while the front foot is still at the riding angle. This causes stress throughout the front leg but more typically the knee joint. This riding position further causes difficulty at lifts and in crowds.

These problems are further exaggerated for people with large feet. Keeping a rider with large feet in a comfortable position can result in at least a portion of the rider's feet dragging on snow when in use, which decreases the turning angle and acts as a brake. This will not only slow down the rider but can cause falls. In order to prevent dragging for people with large feet, the foot is positioned on the board at a larger angle, which exaggerates the above mentioned problem of "torqued knee." Placing feet at the larger angle therefore causes a tedious riding experience and results in more often, as well as more severe, falls and a greater risk of injury.

Thus, there remains a need for an improved system for securely connecting a rider to a snowboard.

SUMMARY OF THE INVENTION

The present invention relates to binding systems for sport boards, such as land sport boards (i.e., snowboards, mountainboards, sandboards, etc.), water sport boards (i.e., wakeboards, kiteboards, sailboards, etc.), and sky sport boards (i.e., skysurfing boards, etc.), and the like. More specifically, the present invention relates to a system for partially and removably securing a user's foot to a deck of a sport board.

One exemplary sport board binding system made in accordance with the present invention includes a receiver which is operably connected to the upper surface of the deck of a sport board, such as a snowboard. The receive is a substantially flat disc having a bottom surface positioned adjacent to the deck of the snowboard, a top surface opposite the bottom surface, and a perimeter edge surface extending between the bottom surface and the top surface. The receiver defines a channel that extends from the edge surface to substantially the center of the receiver. In particular, the receiver defines a head guide which extends from the edge surface to substantially the center of the receiver adjacent to the bottom surface of the receiver. The receiver further defines a neck guide which extends from the edge surface to substantially the center of the receiver adjacent to the top surface of the receiver. The neck guide is coplanar and in communication with the head guide such that the head guide and the neck guide collectively form the channel defined by the receiver. Furthermore, the head guide has a width which is greater than a width of the neck guide such that the channel (i.e., the head guide and the neck guide collectively) has a T-shaped cross-section.

The exemplary binding system further includes an intermediate locking member which is configured to be selectively secured to the receiver. In particular, in some exemplary embodiments, the intermediate locking member includes a lower head and an upper head which are spaced apart and connected by a neck that extends between the lower head and the upper head. The lower head and the upper head are each substantially the same size, however, the neck is narrower than the lower head and the upper head. In this way, the exemplary intermediate locking member is substantially dumbbell shaped, but other shapes are also possible without departing from the spirit and scope of the present invention.

Regardless of the particular shape of the intermediate locking member, when the intermediate locking member is secured to the receiver, the lower head is configured to be selectively housed within the channel of the receiver. In particular, the lower head of the intermediate locking member is configured to be selectively housed within the head guide of the receiver with the neck of the intermediate locking member configured to extend through the neck guide of the receiver. When the lower head is housed within the channel of the receiver, the upper head of the intermediate locking member is positioned a distance away from the top surface of the receiver, as further discussed below.

The binding system of the present invention further includes a door which is configured for removable insertion within the channel into a closed position in which the door substantially fills the channel. In particular, the door is a linear member which includes a lower body having a width substantially the same as the width of the head guide of the channel and an upper body extending along a midline of the lower body and having a width substantially the same as the width of the neck guide of the channel. As such, the door has a T-shaped cross-section similar to the T-shaped cross-section of the channel.

When the door is inserted within the channel, the upper body and the end of the neck guide collectively define a central opening. Likewise, the lower body and the end of the head guide collectively define a pocket that extends partway through the receiver. In operation, the intermediate locking member is inserted into the channel and the door is then inserted into the channel such that the lower head of the intermediate locking member is housed within the pocket formed by the receiver and the door and the neck of the intermediate locking member extends through the central opening formed by the receiver and the door.

The exemplary binding system further includes a boot configured to be worn by a user and designed to selectively engage the upper head of the intermediate locking member. The exemplary boot defines a cavity extending upward from the bottom surface of the sole which contains an engagement mechanism which is configured to selectively house and retain the upper head of the intermediate locking member. The sole of the boot further defines two cable channels which extend from the cavity containing the engagement mechanism to the sides of the sole. The cable channels allow for two cables to extend laterally through the sole allowing a user to disengage the boot from the upper head of the intermediate locking member, as further discussed below.

The engagement mechanism includes a housing and a cover plate configured to connect to the housing such that the housing and cover plate collectively define a cavity. More specifically, the housing includes an upper wall defining a central hole and a sidewall extending around the perimeter of the upper wall with the sidewall defining two oppositely positioned side openings. The cover plate defines a central hole through the cover plate. The central hole of the cover plate is sized to allow the upper head of the intermediate locking member to pass through the cover plate and into the cavity, as discussed further below.

The engagement mechanism further includes two clamping plates positioned within the cavity which operate to selectively hold the upper head of the intermediate locking member within the cavity, as further discussed below. Each of the clamping plates is a substantially flat member having a contact surface with the contact surface of one clamping plate facing towards the contact surface of the other clamping plate. The two clamping plates are connected by two springs which bias the contact surfaces into contact with one another. More specifically, each of the clamping plates defines two spring holes which extend through the clamping plate perpendicular to the contact surface. The springs extend through the spring holes and connect to anchor bolts positioned adjacent to the spring holes and opposite the contact surfaces. Of course, other means of biasing the clamping plates towards one another are also contemplated.

The two cables which extend through the cable channels of the sole of the boot terminate with a cable end cap. Each of the clamping plates also defines a divot in which the cable end caps are seated, allowing the two clamping plates to be pulled apart by the cables. To this end, when the engagement mechanism is in position within the cavity in the sole of the boot, the divots of the clamping plates, the side openings of the housing, and the cable channels are all substantially aligned and the cables to run from the clamping plates, through the side openings of the housing, and through the cable channels.

When the boot is not connected to the intermediate locking member, the two clamping plates are biased in the closed position with the two contact surfaces in contact with one another. By comparison, when the boot is connected to the intermediate locking member, the two clamping plates are spaced apart with the two contact surfaces each in contact with the neck of the intermediate locking member and the upper head of the intermediate locking member positioned above the clamping plates. The clamping plates therefore hold the upper head of the intermediate locking member within the cavity, preventing removal of the intermediate locking member from the cavity of the engagement mechanism.

In operation, in order to engage the boot to the upper head of the intermediate locking member, a user first pulls the cables outward, separating the clamping plates to allow the upper head of the intermediate locking member to pass between the clamping plates. Once the upper head of the intermediate locking member is in position within the hole in the upper wall of the housing, the cables are released and the clamping plates close around the neck of the intermediate locking member.

Similarly, in order to disengage the boot, the cables must both be pulled outward to separate the clamping plates. To this end, in some embodiment, the ends of the cables are connected so as to form a loop which the user can easily reach. Pulling the loop upward causes each of the cables to be pulled outward and thus separates the clamping plates and releasing the intermediate locking member from the engagement mechanism. This allows for a quick disconnect of the boot to the intermediate locking member and, in turn, the deck of the snowboard.

DESCRIPTION OF THE INVENTION

The present invention relates to binding systems for sport boards, such as land sport boards (i.e., snowboards, mountainboards, sandboards, etc.), water sport boards (i.e., wakeboards, kiteboards, sailboards, etc.), and sky sport boards (i.e., skysurfing boards, etc.), and the like. More specifically, the present invention relates to a system for partially and removably securing a user's foot to a deck of a sport board.

Figure 1:
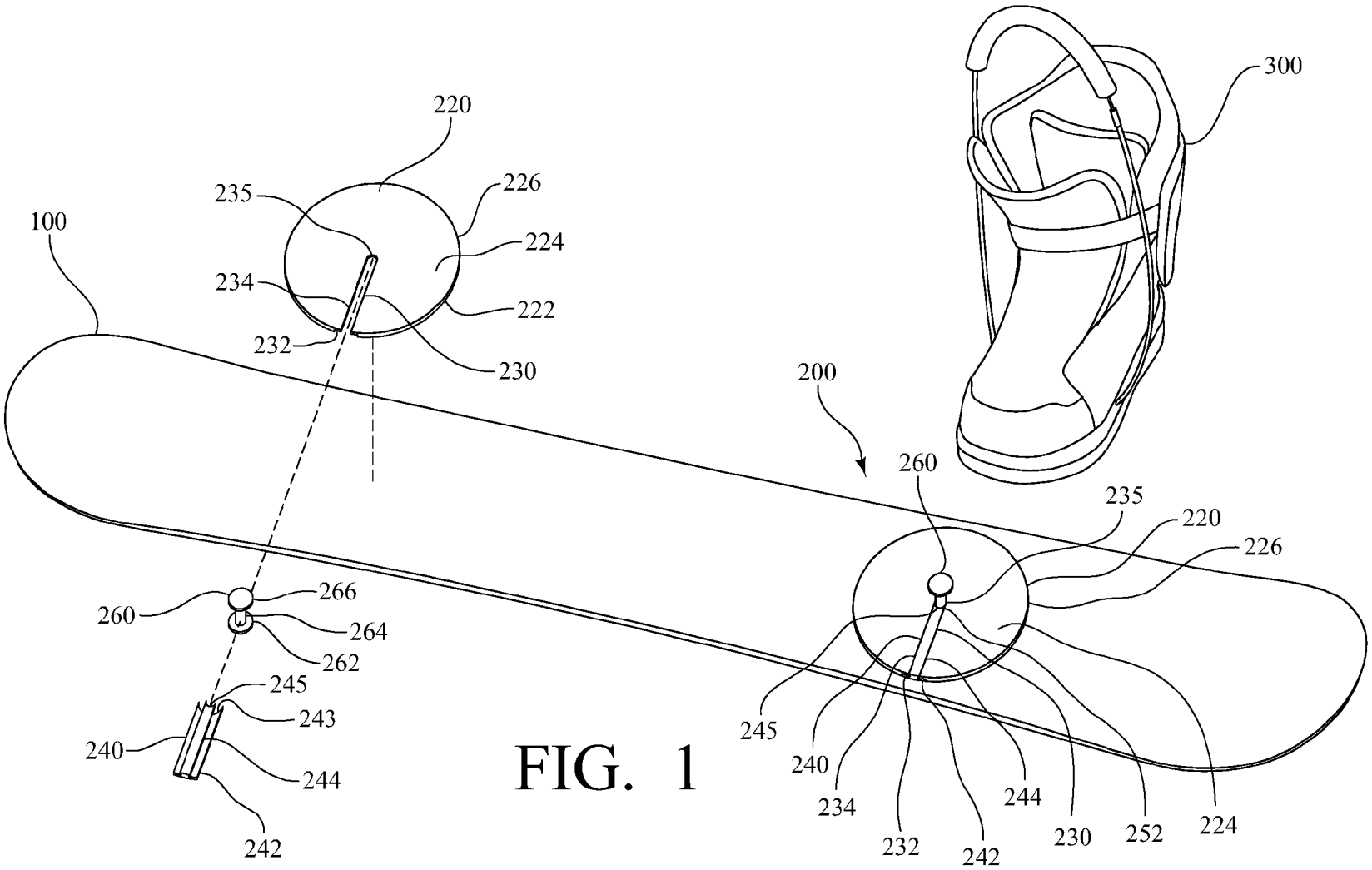
FIG. 1 is a partially exploded top perspective view of the exemplary sport board binding system made in accordance with the present invention.

Referring first to FIG. 1, an exemplary sport board binding system 200 made in accordance with the present invention includes a receiver 220 which is operably connected to the upper surface of the deck 100 of a sport board, such as a snowboard. To this end, although not expressly shown, but as is common of typical binding systems, the receiver 220 defines a pattern of holes which are configured to align with a similar pattern of holes defined in the deck 100 of the snowboard. Fasteners, such as bolts, screw, or the like, are then used to secure the receiver 220 to the deck 100 of the snowboard. As shown in FIG. 1, two such receivers 220 are connected to the deck 100 of the snowboard in positions which correspond to the foot placement of a user, however, as discussed further below, in some embodiments of the present invention, only one receiver 220 of the present invention is used without departing from the spirit and scope of the present invention.

Figure 2A:
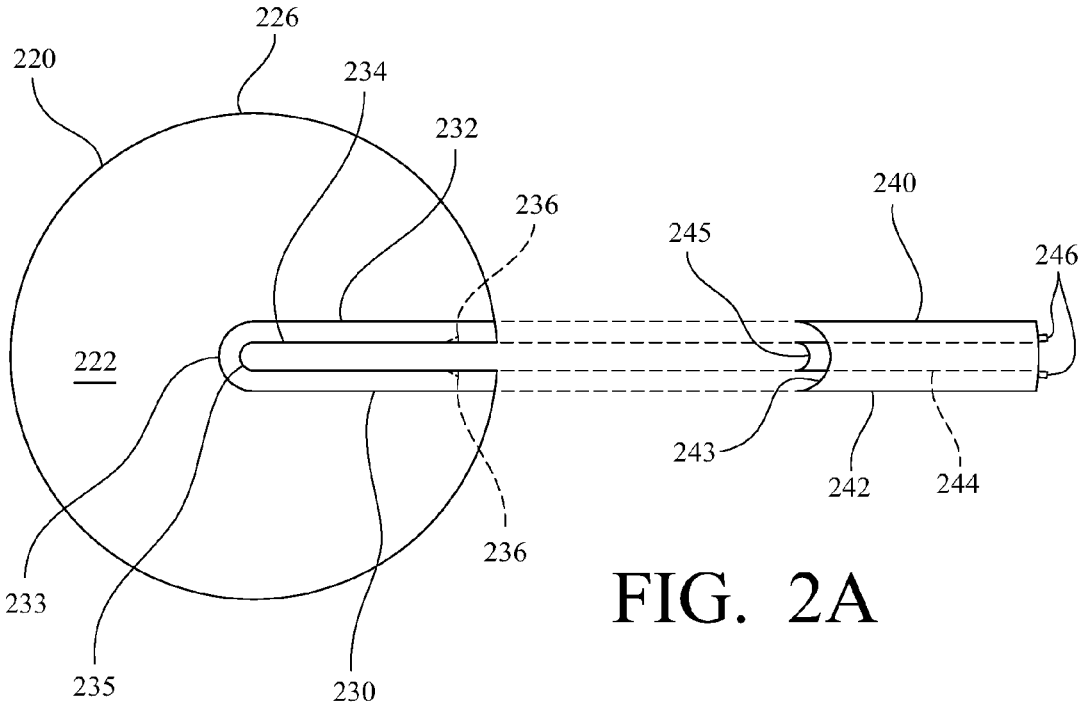
FIG. 2A is a bottom view of the receiver of FIG. 1 with the door removed.
Figure 2B:
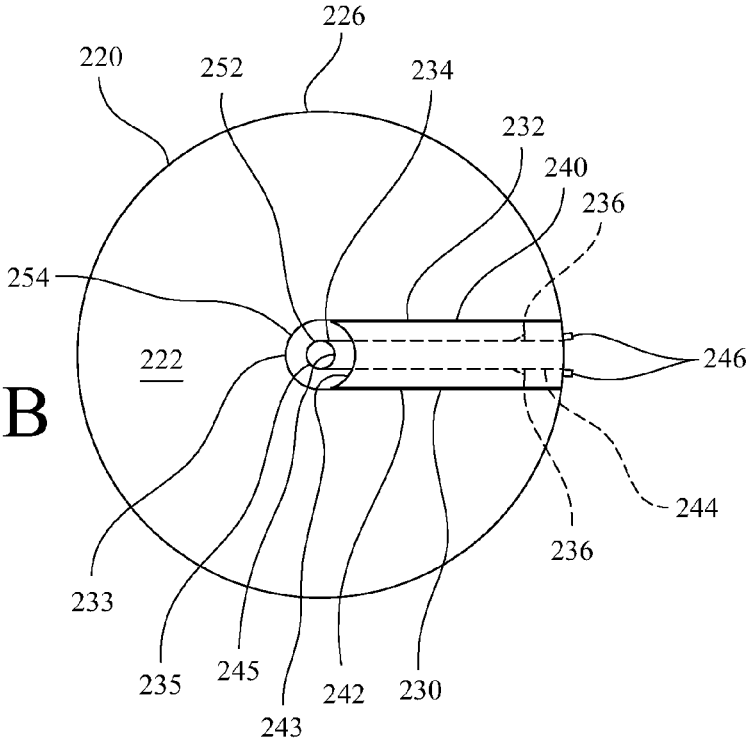
FIG. 2B is a bottom view of the receiver of FIG. 1 with the door positioned within the channel in a closed position.

Referring still to FIG. 1 but now additionally to FIGS. 2A and 2B, in this exemplary embodiment, the receive 220 is a substantially flat disc having a bottom surface 222 positioned adjacent to the deck 100 of the snowboard, a top surface 224 opposite the bottom surface 222, and a perimeter edge surface 226 extending between the bottom surface 222 and the top surface 224. The receiver 220 defines a channel 230 that extends from the edge surface 226 to substantially the center of the receiver 220. In particular, the receiver 220 defines a head guide 232 which, as perhaps best shown in FIG. 2A, extends from the edge surface 226 to substantially the center of the receiver 220 adjacent to the bottom surface 222 of the receiver 220. The head guide 232 terminates in a first curved surface 233, as further discussed below. The receiver 220 further defines a neck guide 234 which, as perhaps best shown in FIG. 2A, extends from the edge surface 226 to substantially the center of the receiver 220 adjacent to the top surface 224 of the receiver 220. The neck guide 234 terminates in a second curved surface 235, as further discussed below. The neck guide 234 is coplanar and in communication with the head guide 232 such that the head guide 232 and the neck guide 234 collectively form the channel 230 defined by the receiver 220. Furthermore, the head guide 232 has a width which is greater than a width of the neck guide 234 such that the channel 230 (i.e., the head guide 232 and the neck guide 234 collectively) has a T-shaped cross-section.

Referring once again specifically to FIG. 1, the binding system 200 of the present invention further includes an intermediate locking member 260 which is configured to be selectively secured to the receiver 220. In particular, in this exemplary embodiment, the intermediate locking member 260 includes lower head 262 and an upper head 266 which are spaced apart and connected by a neck 264 that extends between the lower head 262 and the upper head 266. The lower head 262 and the upper head 266 are each substantially the same size, however, the neck 264 is narrower than the lower head 262 and the upper head 266. In this way, the exemplary intermediate locking member 260 is substantially dumbbell shaped, but other shapes are also possible without departing from the spirit and scope of the present invention.

Regardless of the particular shape of the intermediate locking member 260, when the intermediate locking member 260 is secured to the receiver 220, the lower head 262 is configured to be selectively housed within the channel 230 of the receiver 220. In particular, the lower head 262 of the intermediate locking member 260 is configured to be selectively housed within the head guide 232 of the receiver 220 with the neck 264 of the intermediate locking member 260 configured to extend through the neck guide 234 of the receiver 220. As shown in FIG. 1, when the lower head 262 is housed within the channel 230 of the receiver 220, the upper head 266 of the intermediate locking member 260 is positioned a distance away from the top surface 224 of the receiver 220, as further discussed below.

Referring now once again to FIGS. 1, 2A, and 2B, the binding system 200 of the present invention further includes a door 240 which is configured for removable insertion within the channel 230 into a closed position in which the door 240 substantially fills the channel 230. In particular, the door 240 is a linear member which includes a lower body 242 having a width substantially the same as the width of the head guide 232 of the channel 230 and an upper body 244 extending along a midline of the lower body 242 and having a width substantially the same as the width of the neck guide 234 of the channel 230. As such, the door 240 has a T-shaped cross-section similar to the T-shaped cross-section of the channel 230.

The interaction between the door 240 and the channel 230 will now be described in further detail below with respect to FIGS. 2A, 2B, 3, and 4. Referring first specifically to FIGS. 2A and 2B, the lower body 242 of the door 240 includes a curved distal end 243 and the upper body 244 of the door 240 similar includes a curved distal end 245. As shown in FIG. 2B, when the door 240 is inserted within the channel 230, the curved distal end 245 of the upper body 244 is positioned adjacent to the second curved surface 235 at the end of the neck guide 234 such that the curved distal end 245 of the upper body 244 and the second curved surface 235 of the receiver 220 collectively define a central opening 252. Likewise, the curved distal end 243 of the lower body 242 is similarly positioned adjacent to the first curved surface 233 at the end of the head guide 232 such that the curved distal end 243 of the lower body 242 and the first curved surface 233 of the receiver 220 collectively define a pocket 254 that extends partway through the receiver 220. In operation, the intermediate locking member 260 is inserted into the channel 230 until the lower head 262 is adjacent to the first curved surface 233 and the neck 264 is adjacent to the second curved surface 235. The door 240 is then inserted into the channel 230 such that the lower head 262 of the intermediate locking member 260 is housed within the pocket 254 formed by the receiver 220 and the door 240 and the neck 264 of the intermediate locking member 260 extends through the central opening 252 formed by the receiver 220 and the door 240.

Figure 3:
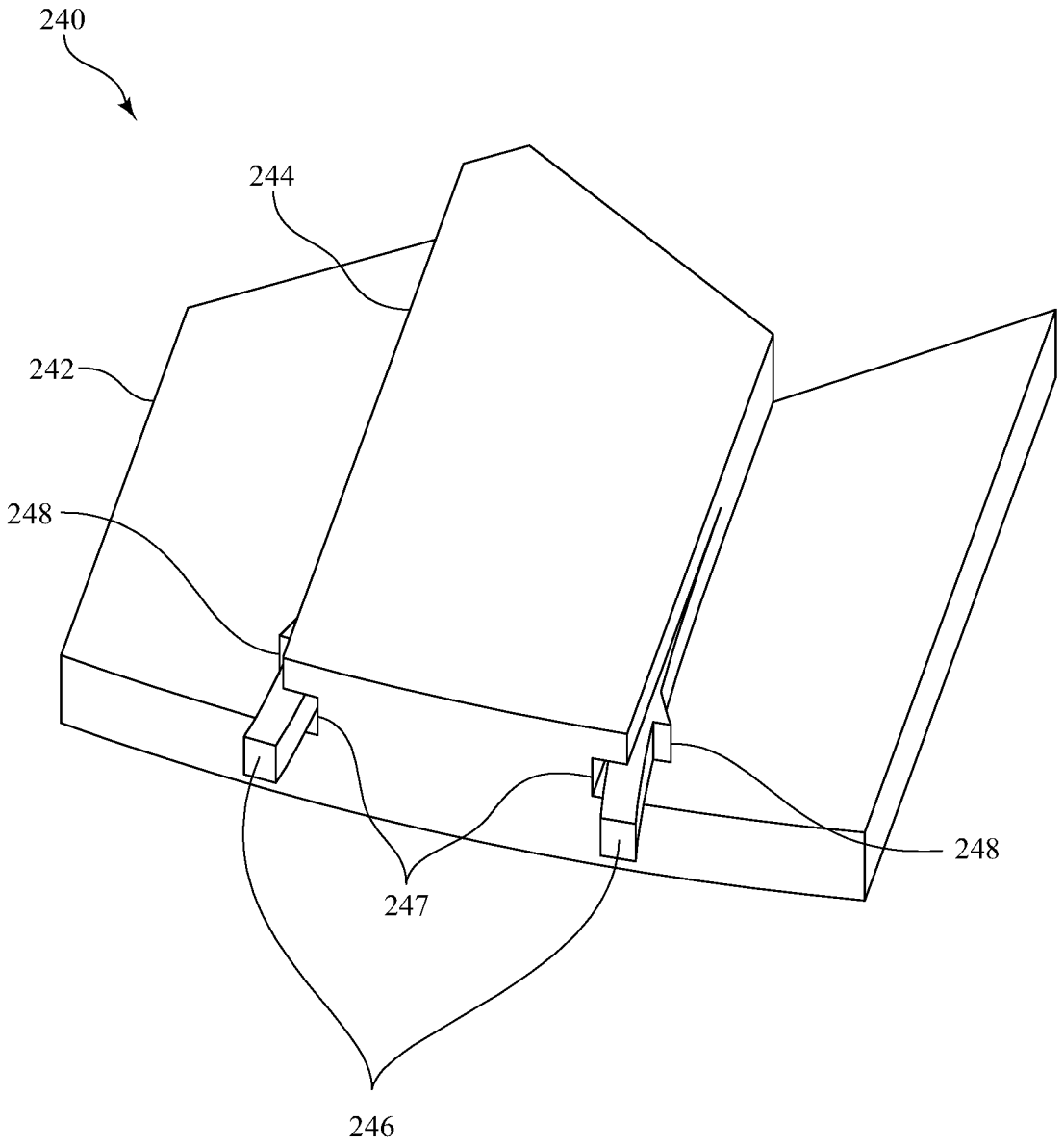
FIG. 3 is a detail view of the end of the door.
Figure 4:
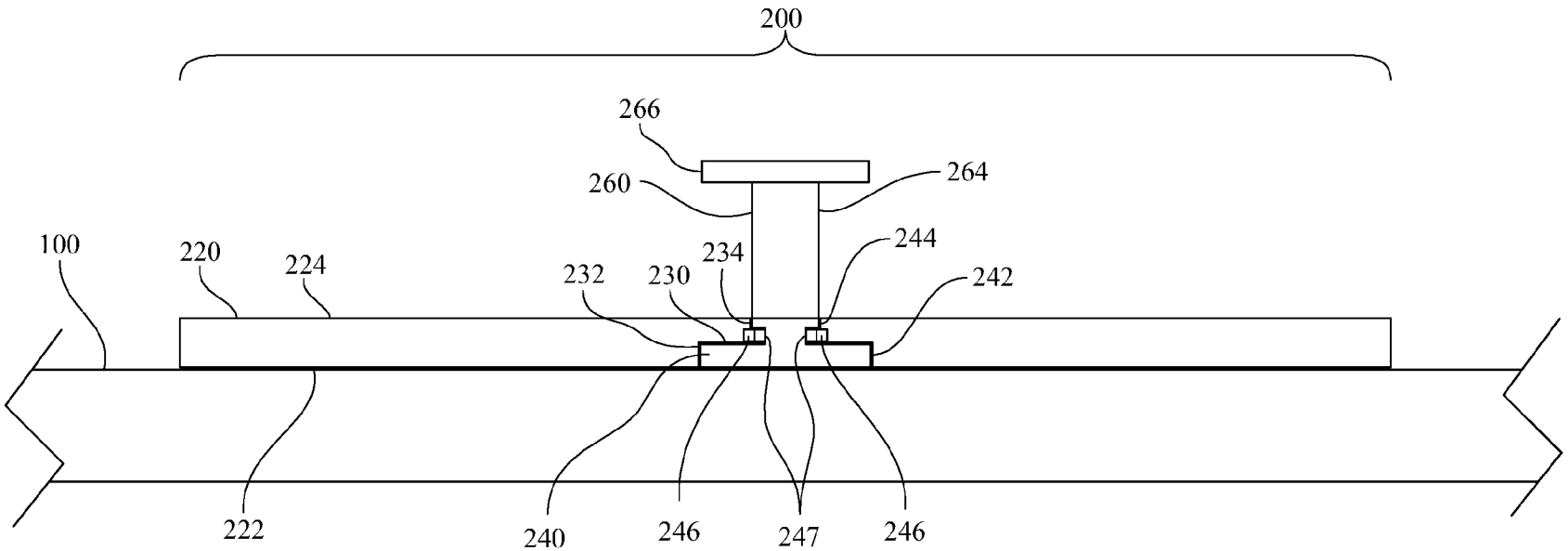
FIG. 4 is a side view of the sport board binding system of FIG. 1.

Referring still to FIGS. 2A and 2B but now additionally to FIGS. 3 and 4, the exemplary door 240 further includes a locking mechanism which maintains the door 240 in the closed position within the channel 230 until a user releases the locking mechanism. In the embodiment shown in FIGS. 3 and 4, the locking mechanism includes one or more flexible locking members 246 that extend along the length of door 240 and which, when the door 240 is in the closed position, extend beyond the edge surface 226 of the receiver, as shown in FIG. 2B. In particular, each of the locking members 246 is positioned within a cavity 247 defined along the side of the upper body 244 of the door 240 which allows the locking member 246 to flex inward when depressed by a user. Furthermore, each of the locking members 246 includes a protrusion 248 along the length of the locking member 246 which engages a locking cavity 236 defined by the receiver 220 adjacent to the neck guide 234. In particular, when the door 240 is in the closed position, the protrusions 248 of the locking members 246 are positioned within the respective locking cavity 236 and the door 240 is prevented from sliding out of the channel 230. Upon depressing the locking members 246 inward into the cavities 247 in the upper body 244 of the door 240, the protrusions 248 exit the locking cavities 236 and the door 240 is allows to slide out of the channel 230. Of course, this is merely one possible configuration of the locking mechanism of the present invention. In some embodiments, the locking members do not include protrusions but instead rely on friction to maintain the door in the closed position. Other locking mechanism including, for example, screws, bolts, snaps, and the like are also contemplated without departing from the spirit and scope of the present invention.

Although not expressly shown, in some embodiments of the present invention, the receiver and the intermediate locking member are provided as a single unitary member. That is, a receiver having a shaft extending upward from the upper surface of the receiver is provided and operably connected to the deck of a sport board such that the shaft extends upward from the deck of the sport board. In these embodiments, the shaft includes an enlarged upper head similar to the upper head 266 of the intermediate locking member 260 described above with respect to FIGS. 1-4. Of course, such a receiver does not define a channel and therefore there is no door configured for removable insertion within a channel.

Figure 5:
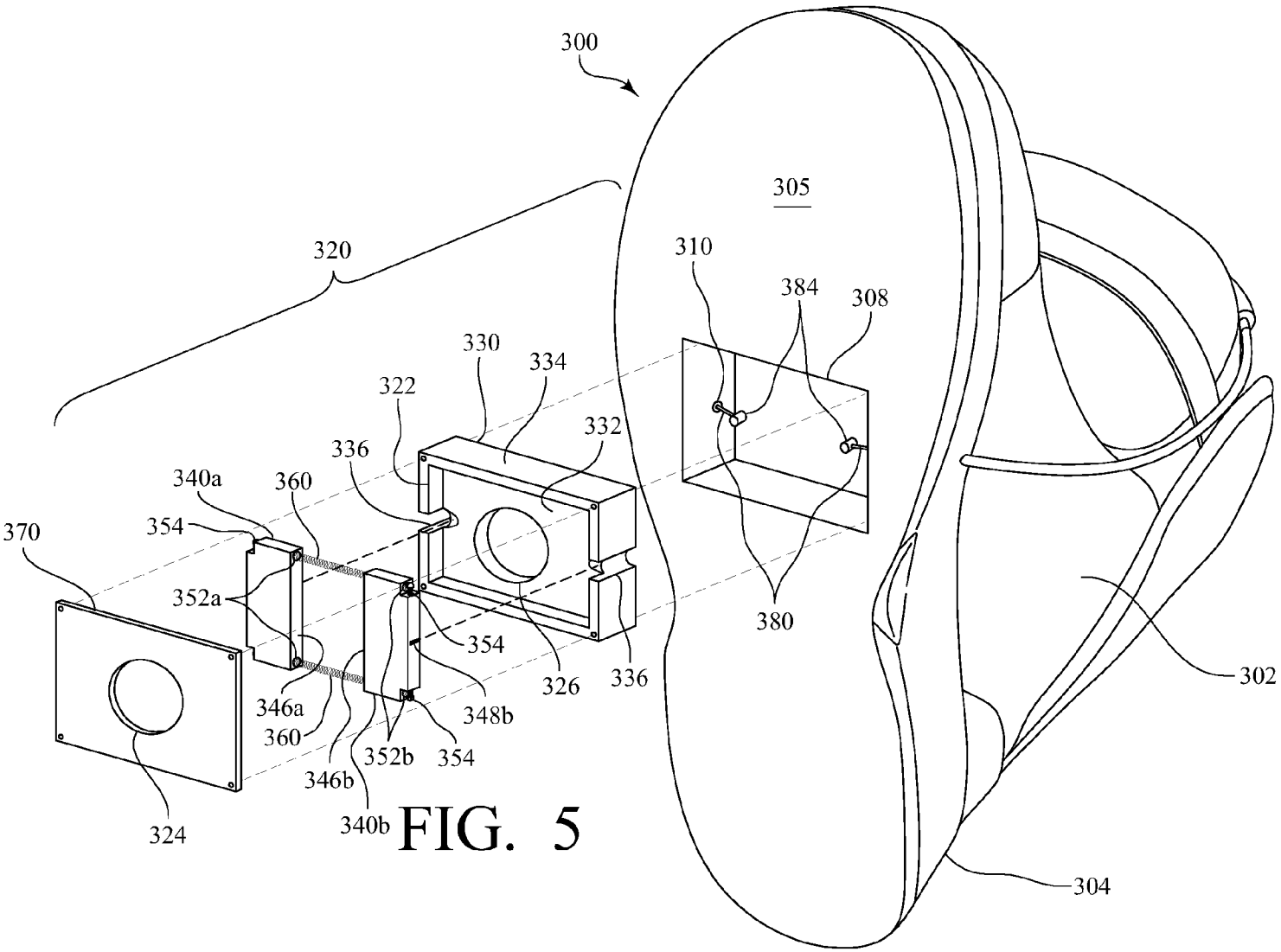
FIG. 5 is an exploded bottom perspective view of the boot of FIG. 1.
Figure 6:
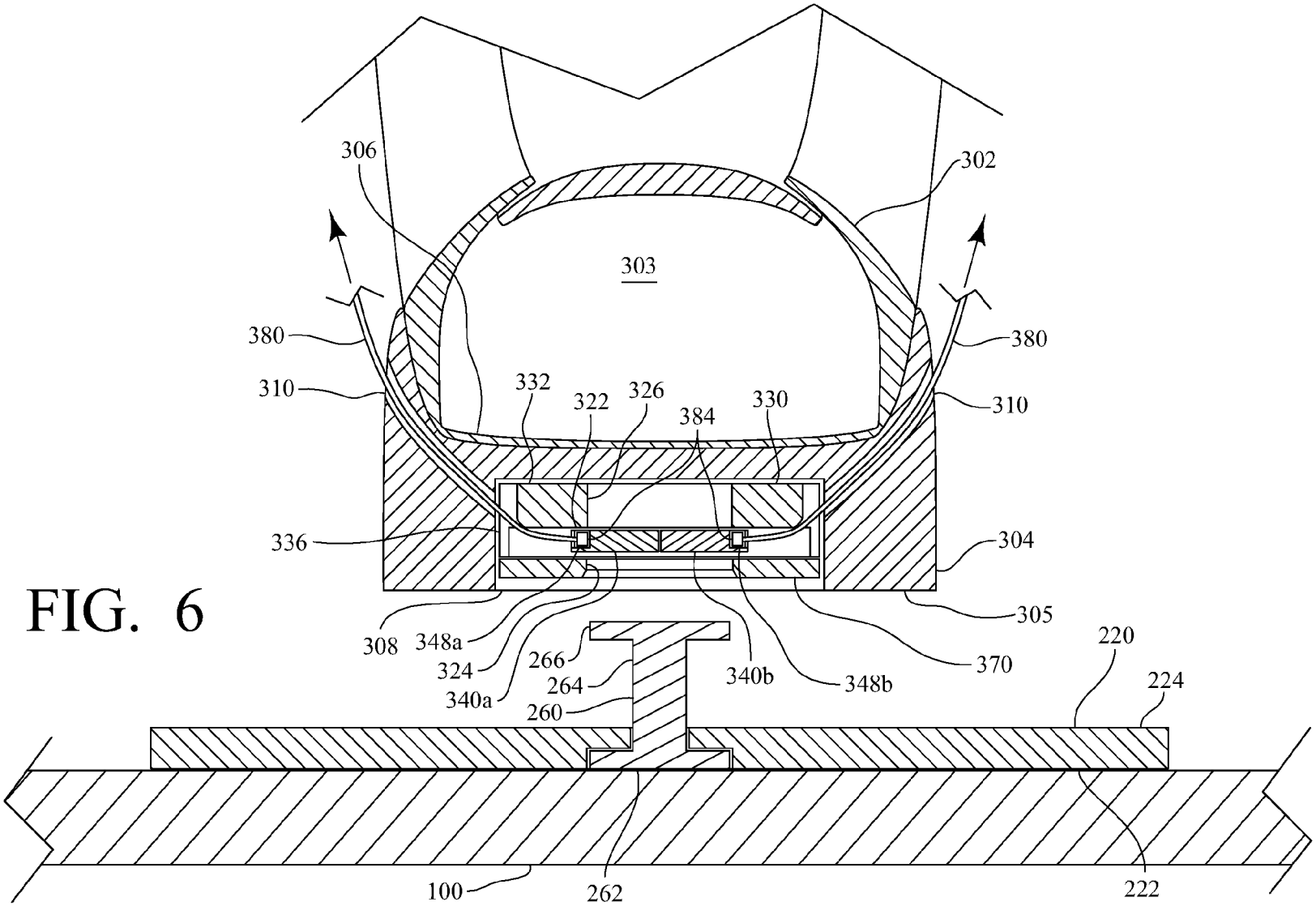
FIG. 6 is a side sectional view of the sport board binding system of FIG. 1 with the boot detached from the receiver.
Figure 7:
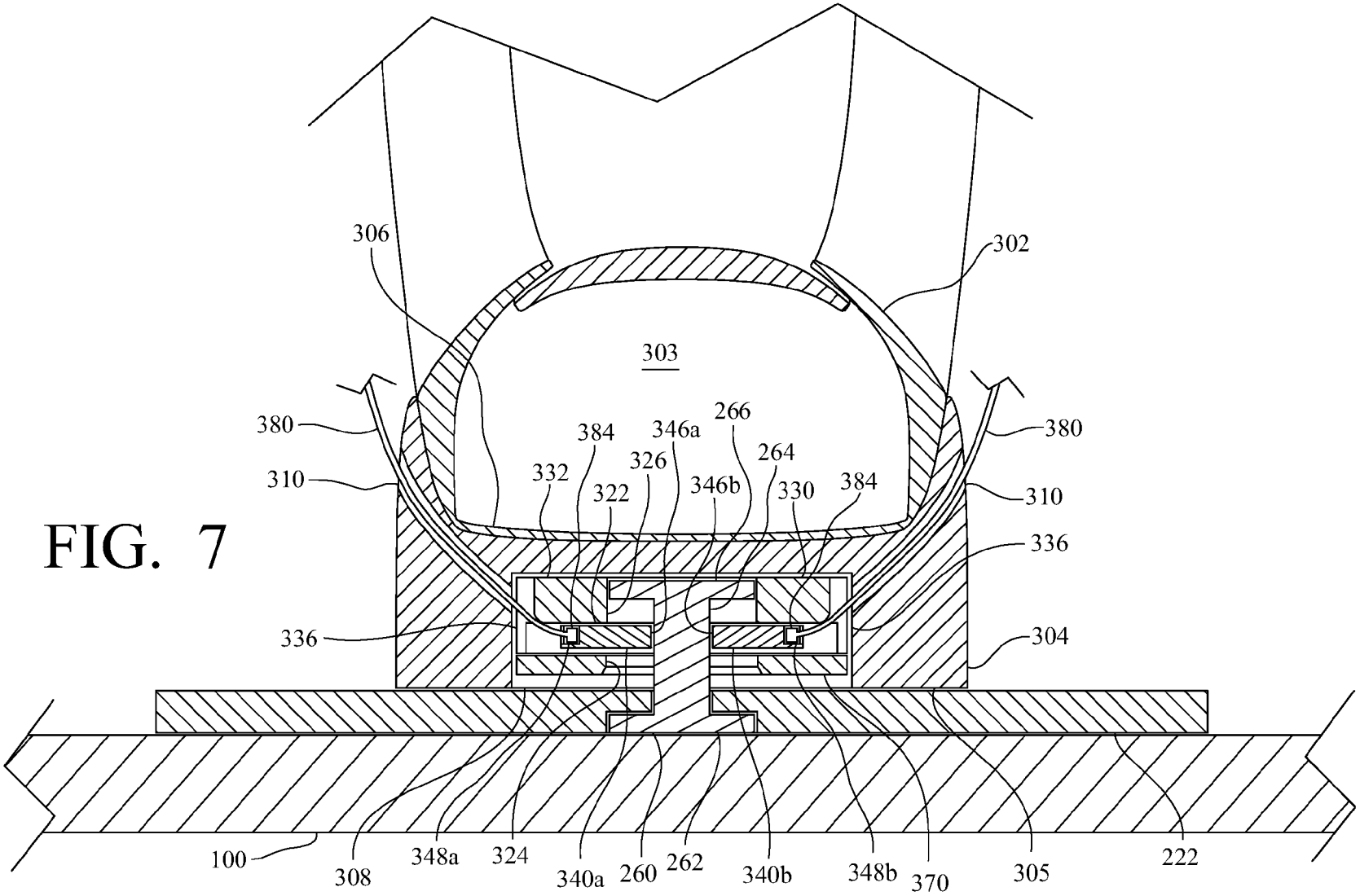
FIG. 7 is a side sectional view of the sport board binding system of FIG. 1 with the boot attached to the receiver.

Regardless of the particular configuration of the receiver and intermediate locking member, as shown in FIG. 1, in some embodiments of the present invention, the binding system 200 further includes a boot 300 configured to be worn by a user and designed to selectively engage the upper head 266 of the intermediate locking member 260. Referring now to FIGS. 5-7, the exemplary boot 300 includes several features common to boots of the prior art. In particular, the boot 300 of the present invention includes an upper 302 connected to a sole 304 to collectively define the space 303 which accepts the user's foot. Furthermore, the sole 304 itself has a bottom surface 305 and includes an insole 306 opposite the bottom surface 305. The insole 306 is the portion of the sole 304 which directly supports the bottom of a user's foot positioned within the boot 300. Unlike a typical boot, however, the sole 304 of the exemplary boot 300 further defines a cavity 308 extending upward from the bottom surface 305 of the sole 304 which contains an engagement mechanism 320 which is configured to selectively house and retain the upper head 266 of the intermediate locking member 260, as shown in FIG. 7. In some embodiments, the insole 306 is a removable plate which is used as an anchor point for the engagement mechanism 320, but other means of securing the engagement mechanism 320 within the cavity 308 of the sole 304 of the boot 300 are also contemplated.

Regardless, the sole 304 of the boot 300 further defines two cable channels 310 which extend from the cavity 308 containing the engagement mechanism 320 to the sides of the sole 304. The cable channels 310 allow for two cables 380 to extend laterally through the sole 304 allowing a user to disengage the boot 300 from the upper head 266 of the intermediate locking member 260, as further discussed below.

Referring now specifically to FIG. 5, the engagement mechanism 320 includes a housing 330 and a cover plate 370 configured to connect to the housing 330 such that the housing 330 and cover plate 370 collectively define a cavity 322. More specifically, and as perhaps best shown in FIG. 5, the housing 330 includes an upper wall 332 defining a central hole 326 and a sidewall 334 extending around the perimeter of the upper wall 332 with the sidewall 334 defining two oppositely positioned side openings 336. The cover plate 370 defines a central hole 324 through the cover plate 370. The central hole 324 of the cover plate 370 is sized to allow the upper head 266 of the intermediate locking member 260 to pass through the cover plate 370 and into the cavity 322, as discussed further below.

The engagement mechanism 320 further includes two clamping plates 340*a*, 340*b* positioned within the cavity 322 which operate to selectively hold the upper head 266 of the intermediate locking member 260 within the cavity 322, as further discussed below. Each of the clamping plates 340*a*, 340*b* is a substantially flat member having a contact surface 346*a*, 346*b* with the contact surface 346*a* of one clamping plate 340*a* facing towards the contact surface 346*b* of the other clamping plate 340*b*. The two clamping plates 340*a*, 340*b* are connected by two springs 360 which bias the contact surfaces 346*a*, 346*b* into contact with one another, such as is shown in FIG. 6. More specifically, each of the clamping plates 340*a*, 340*b* defines two spring holes 352*a*, 352*b* which extend through the clamping plate 340*a*, 340*b* perpendicular to the contact surface 346*a*, 346*b*. The springs 360 extend through the spring holes 352*a*, 352*b* and connect to anchor bolts 354 positioned adjacent to the spring holes 352*a*, 352*b* and opposite the contact surfaces 346*a*, 346*b*. Of course, other means of biasing the clamping plates 340*a*, 340*b* towards one another are also contemplated.

As perhaps best shown in FIG. 5, the two cables 380 which extend through the cable channels 310 of the sole 304 of the boot 300 terminate with a cable end cap 384. Each of the clamping plates 340*a*, 340*b* also defines a divot 348*a*, 348*b* in which the cable end caps 384 are seated, allowing the two clamping plates 340*a*, 340*b* to be pulled apart by the cables 380. To this end, and as shown in FIGS. 6-7, when the engagement mechanism 320 is positioned within the cavity 308 in the sole 304 of the boot 300, the divots 348*a*, 348*b* of the clamping plates 340*a*, 340*b*, the side openings 336 of the housing 330, and the cable channels 310 are all substantially aligned and the cables 380 to run from the clamping plates 340*a*, 340*b*, through the side openings 336 of the housing 330, and through the cable channels 310.

Referring now specifically to FIG. 6, when the boot 300 is not connected to the intermediate locking member 260, the two clamping plates 340*a*, 340*b* are biased in the closed position with the two contact surfaces 346*a*, 346*b* in contact with one another. By comparison, as shown in FIG. 7, when the boot 300 is connected to the intermediate locking member 260, the two clamping plates 340*a*, 340*b* are spaced apart with the two contact surfaces 346*a*, 346*b* each in contact with the neck 264 of the intermediate locking member 260 and the upper head 266 of the intermediate locking member 260 positioned above the clamping plates 340*a*, 340*b*. The clamping plates 340*a*, 340*b* therefore hold the upper head 266 of the intermediate locking member 260 within the cavity 322, preventing removal of the intermediate locking member 260 from the cavity 322 of the engagement mechanism 320. As also shown in FIG. 7, when the boot 300 is connected to the intermediate locking member 260, the upper head 266 of the intermediate locking member 260 is positioned within the hole 326 in the upper wall 332 of the housing 330. Importantly, the upper head 266 of the intermediate locking member 260 does not contact the insole 306 of the boot 300. Accordingly, when a user applies force to the boot 300, for example, during a rough landing, the force is transferred entirely through the sole 304 of the boot 300 into the receiver 220 and no weight is directed into the intermediate locking member 260. Therefore, the intermediate locking member 260 will not hurt the user's foot upon a rough landing.

In operation, in order to engage the boot 300 to the upper head 266 of the intermediate locking member 260, a user first pulls the cables 380 outward (indicated by arrows in FIG. 6), separating the clamping plates 340*a*, 340*b* to allow the upper head 266 of the intermediate locking member 260 to pass between the clamping plates 340*a*, 340*b*. Once the upper head 255 of the intermediate locking member 260 is in position within the hole 326 in the upper wall 332 of the housing 330, the cables 380 are released and the clamping plates 340*a*, 340*b* close around the neck 264 of the intermediate locking member 260, as shown in FIG. 7. Although not shown, it is contemplated that in some embodiments, the lower sides of the clamping plates 340*a*, 304*b* are tapered upward towards the contact surface, such that, when the clamping plates 340*a*, 304*b* are in the closed position and a user, for example, steps on the intermediate locking member 260, the upper head 266 of the intermediate locking member 260 slides along the tapered sides of the clamping plates 340*a*, 340*b* forcing the clamping plates 340*a*, 340*b* outward. The upper head 266 of the intermediate locking member 260 then progresses upward between the clamping plates 340*a*, 340*b* until the clamping plates 340*a*,340*b* close around the neck 264 of the intermediate locking member 260, substantially as shown in FIG. 7. In this way, the boot 300 can engage the intermediate locking member 260 without requiring the user to pull on the cables 380.

Regardless of the method of engaging the boot 300 to the upper head 266 of the intermediate locking member 260, in order to disengage the boot 300, the clamping plates 340*a*, 340*b* must be separated by overcoming the biasing force of the springs 360. In the embodiment shown in FIGS. 5-7, the cables 380 must both be pulled outward to separate the clamping plates 340*a*, 340*b*. To this end, and as perhaps best shown in FIG. 1, in this embodiment, the ends of the cables 380 are connected so as to form a loop which the user can easily reach. Pulling the loop upward causes each of the cables 380 to be pulled outward and thus separates the clamping plates 340*a*, 340*b* and releasing the intermediate locking member 260 from the engagement mechanism 320. This allows for a quick disconnect of the boot 300 to the intermediate locking member 260 and, in turn, the deck 100 of the snowboard. Other means of separating the clamping plates 340*a*, 340*b* can also be used without departing from the spirit and scope of the present invention.

Furthermore, once the boot 300 of the user is connected, the binding system 200 of the present invention further provides increased freedom of movement for the rider relative to the deck 100 of the snowboard. Specifically, and as perhaps best shown in FIG. 1, each of the lower head 262, the neck 264, and the upper head 266 are substantially round. As such, neither the interface between the intermediate locking member 260 and the receiver 220 nor the interface between the intermediate locking member 260 and the boot 300 restrict the intermediate locking member 260 from rotating. As such, the boot 300 is allow to rotate relative to the receiver 220, and thus the deck 100 of the snowboard, around the central axis of the intermediate locking member 260.

Figure 8:
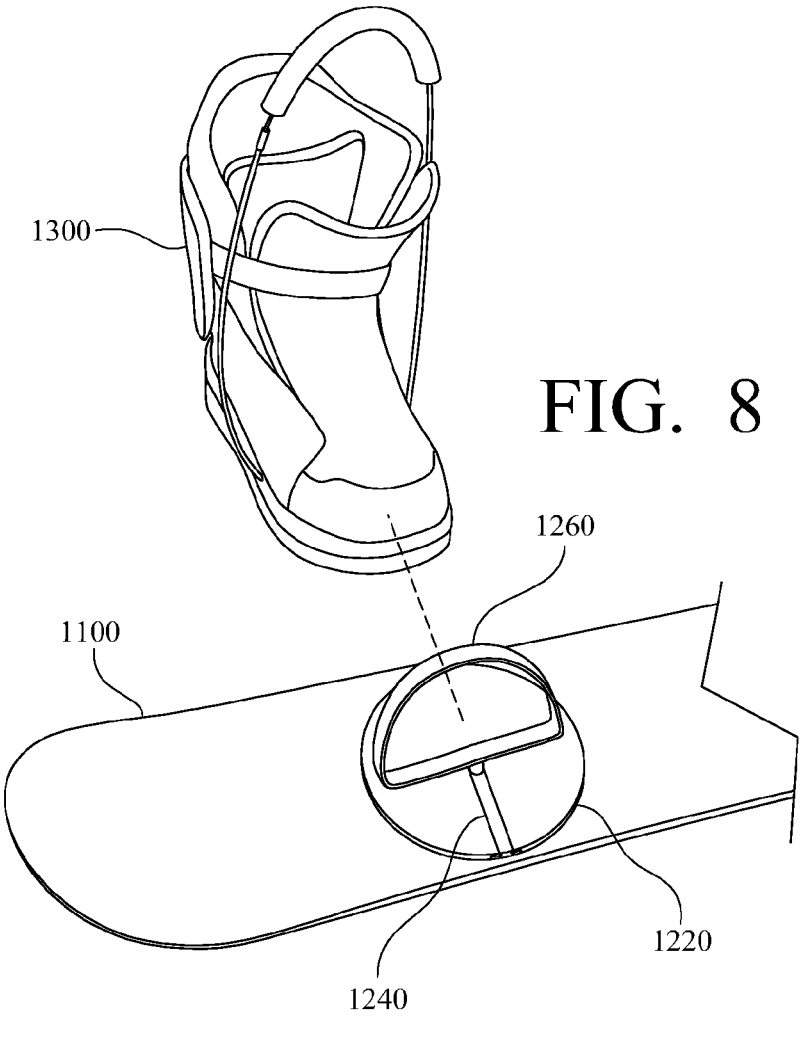
FIG. 8 is a partial top perspective view of another exemplary sport board binding system made in accordance with the present invention.
Figure 9:
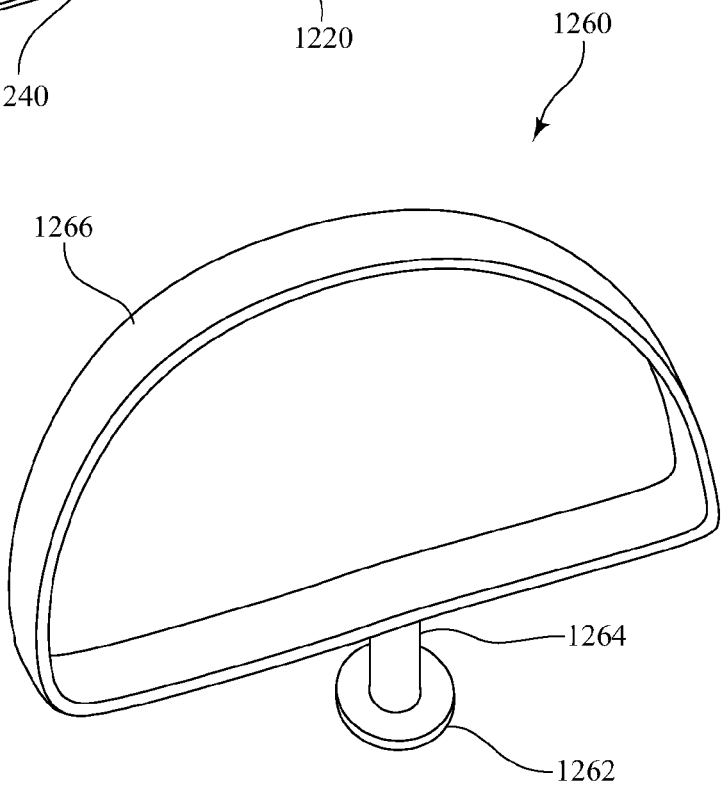
FIG. 9 is a detailed view of the boot loop of FIG. 8.

As previously mentioned, instead of including two receivers 220 of the present invention, such as is shown in FIG. 1, it is contemplated that in some embodiments, another binding system used in conjunction with one receiver 220 of the present invention. For example, a traditional binding system which rigidly connects a user's foot to the deck 100 of the snowboard can be used with one receiver 220 of the present invention. In some particular embodiments, the boot 300 of the present invention is configured so as to still be compatible with a traditional binding system known in the art. That is to say, because the engagement mechanism 320 is contained entirely within the cavity 308 in the sole 304 of the boot 300, it does not interfere with a traditional binding system. However, and referring now to FIG. 8, in another exemplary embodiment of the present invention, another sport board binding system 1200 is provided which further increases the range of movement between a boot 1300 and the binding system 1200. The binding system 1200 shown in FIG. 8, comprises a receiver 1220 and door 1240 substantially similar to the receiver 220 and door 240 described above with respect to FIGS. 1-4. Instead of using an intermediate locking member to connect the boot 1300 to the receiver, however, the binding system 1200 shown in FIG. 8 includes a boot loop 1260 which is configured to be selectively secured to the receiver 1220. Referring now to FIG. 9, the boot loop 1260 includes lower head 1262 and an upper loop 1266 which are spaced apart and connected by a neck 1264 that extends between the lower head 1262 and the upper loop 1266.

The lower head 1262 and neck 1264 are substantially similar to the lower head 262 and neck 264 of the intermediate locking member 260 and engage the receiver 1220 in substantially the same manner as the lower head 262 and neck 264 of the intermediate locking member 260 engage the receiver 220 as described above with respect to FIGS. 1-4. The upper loop 1266 of the boot loop 1260 is sized and configured such that the toe of a boot 1300 can be positioned within the upper loop 1266 of the boot loop 1260, as shown in FIG. 8. Furthermore, it is contemplated that in some embodiments, the upper loop 1266 is adjustable in size and shape so as to be customizable to the particular dimensions of the boot 1300. Regardless, a user is readily able to slide the boot 1300 into an out of the boot loop 1260 and therefore can quickly free the boot 1300 during tricks on the ground or in the air. Furthermore, the boot loop 1260 can also be used as a handle during aerial maneuvers with the boot 1300 in or out of the boot loop 1260.

Figure 10:
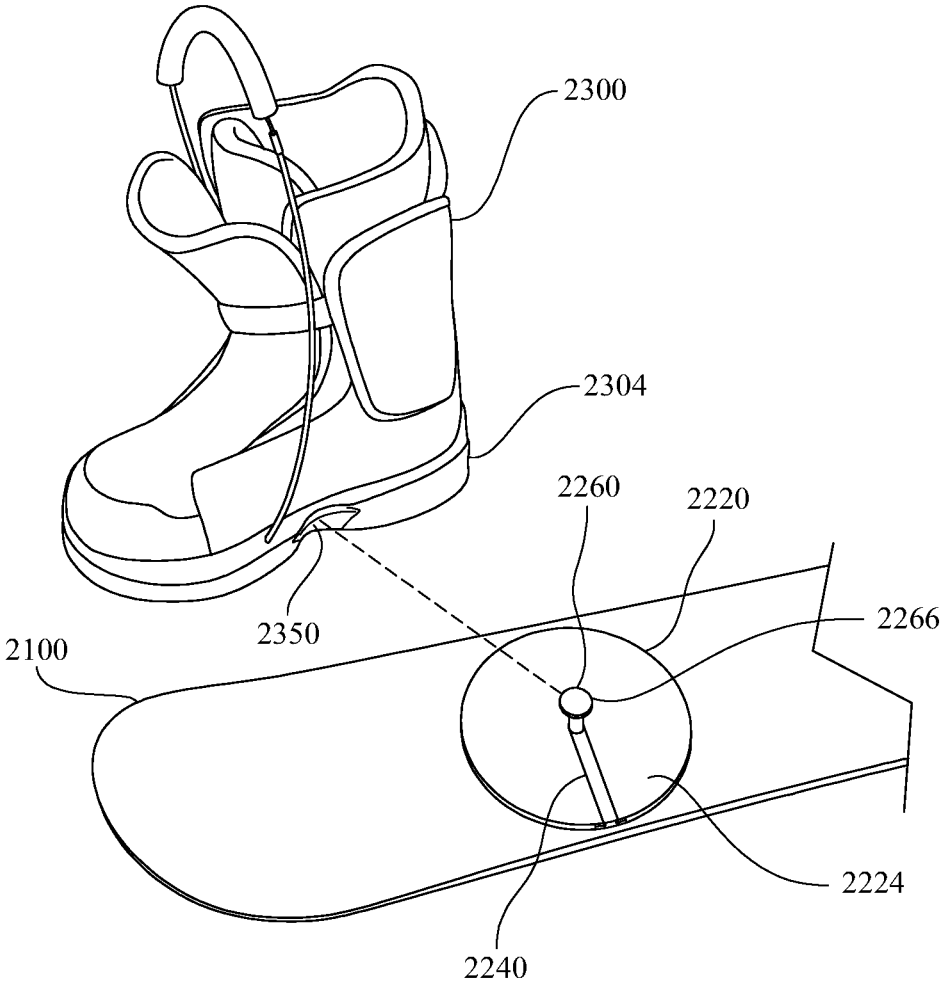
FIG. 10 is a partial top perspective view of another exemplary sport board binding system made in accordance with the present invention.

Referring now to FIG. 10, in another exemplary embodiment of the present invention, another sport board binding system 2200 is provided which also increases the range of movement between a boot 2300 and the binding system 2200. The binding system 2200 shown in FIG. 10, comprises a receiver 2220, door 2240, and intermediate locking member 2260 substantially similar to the receiver 220, door 240, and intermediate locking member 260 described above with respect to FIGS. 1-4. Instead of using an engagement mechanism contained within the bottom of the sole 2304 of the boot 2300, the boot 2300 shown in FIG. 10 defines a side cavity 2350 in the side of the sole 2304 which is configured to engage the upper head 2266 of the intermediate locking member 2260. Specifically, in use, a user slides the boot 2300 along the upper surface 2224 of the receiver 2220 until the upper head 2266 of the intermediate locking member 2260 is partially positioned within the side cavity 2350. The side cavity 2350 is configured to substantially surround a portion of the upper head 2266. That is to say, a lower portion of the side cavity 2350 is positioned below the upper head 2366, and therefore, the user is able to direct the snowboard by the contact between the side cavity 2350 and the intermediate locking member 2260. Of course, the side cavity 2350 shown in FIG. 10 can also be used in conjunction with the boot 300 described above with respect to FIGS. 5-7 allowing for multiple ways to control the snowboard during use.

Figure 11:
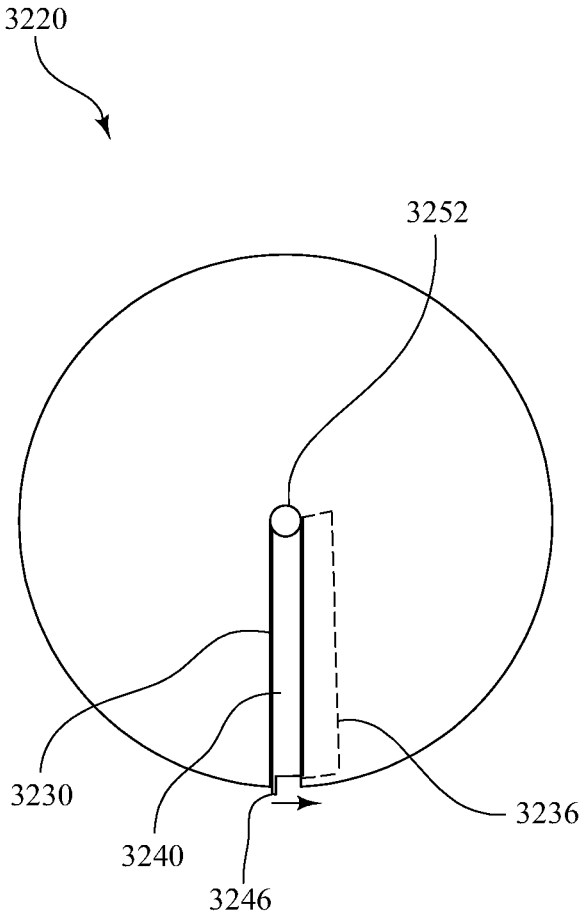
FIG. 11 is a top view of another exemplary receiver made in accordance with the present invention.

Referring now to FIG. 11, in another exemplary embodiment of the present invention, a receiver 3220 includes a door 3240 which is operated by rotating the door 3240 to open a channel 3230 defined by the receiver 3220. In particular, as shown in FIG. 11, the door 3240 includes a lever 3246 which allows a user to rotate the door 3240 from the closed position shown in FIG. 11, into an open position in which the door 3240 is house within a nesting area 3236 defined by the receiver 3220. It is contemplated that the door 3240 can be biased into the closed position by springs, or other similar devices. In any event, when the door 3240 is in the closed position, a central opening 3252 and pocket (not shown) are defined by the door 3240 and the receiver 3220 in substantially the same manner as the central opening 252 and pocket 254 described above with respect to FIGS. 2A and 2B. As such, the intermediate locking member 260 described above can be used with the receiver 3220 shown in FIG. 11 in substantially the same manner as described above.

Although the above embodiments were described with respect to a snowboard and corresponding boot, it should be understood that the same concepts are applicable to other sport boards and boots. Furthermore, in some embodiments, rather than having the sole which contains the engagement mechanism permanently attached to the remainder of the boot, an independent sole may be removably attached to a preexisting boot, such as for example, a wakeboard boot. This removable sole would be configured substantially the same as the sole of the boots described above and would include all features of the engagement mechanism necessary for use of the systems of the present invention. In this way a preexisting boot for a variety of sports can be readily adapted for use with the systems of the present invention.

One of ordinary skill in the art will recognize that additional embodiments are possible without departing from the teachings of the present invention. This detailed description, and particularly the specific details of the exemplary embodiments disclosed therein, is given primarily for clarity of understanding, and no unnecessary limitations are to be understood therefrom, for modifications will become obvious to those skilled in the art upon reading this disclosure and may be made without departing from the spirit or scope of the present invention.

What is claimed is:

1. A sport board binding system, comprising:

a receiver having a bottom surface, a top surface, and a perimeter edge surface between the bottom surface and the top surface, the receiver configured to be secured to a deck of a sport board with the bottom surface of the receiver positioned adjacent to an upper surface of the deck of the sport board, the receiver defining a channel open at the top surface along substantially the length of the channel, the channel extending inward from the perimeter edge surface of the receiver;

a boot configured to be worn by a user, the boot including an engagement mechanism; and an intermediate locking member having a lower head connected to an upper head by way of a neck that is narrower in a lateral direction than the upper head, the lower head selectively housed within the channel of the receiver and the upper head selectively housed within the engagement mechanism of the boot.

2. The sport board binding system of claim 1, wherein the engagement mechanism includes one or more clamping plates movable between a locked position in which the upper head of the intermediate locking member is retained within the engagement mechanism, and an unlocked position in which the upper head of the intermediate locking member is removable from the engagement mechanism.

3. The sport board binding system of claim 2, further comprising one or more wires, each wire operably connected to the one or more clamping plates such that, upon pulling the one or more wires, the one or more clamping plates move from the locked position to the unlocked position.

4. The sport board binding system of claim 1, wherein the engagement mechanism includes two clamping plates movable between a locked position in which the upper head of the intermediate locking member is retained within the engagement mechanism, and an unlocked position in which the upper head of the intermediate locking member is removable from the engagement mechanism.

5. The sport board binding system of claim 4, wherein the clamping plates are connected by one or more springs which bias the clamping plates into the locked positioned.

6. The sport board binding system of claim 4, wherein, when the clamping plates are in the locked positioned, the clamping plates are positioned adjacent to the neck of the intermediate locking member between the lower head of the intermediate locking member and the upper head of the intermediate locking member; and wherein, when the clamping plates are in the unlocked positioned, the clamping plates are spaced apart a distance that allows the upper head of the intermediate locking member to pass between the clamping plates.

7. The sport board binding system of claim 6, further comprising two wires, each wire operably connected to one of the clamping plates such that, upon pulling the wires, the clamping plates move from the locked position to the unlocked position.

8. The sport board binding system of claim 1, wherein the receiver defines a head guide extending inward from the perimeter edge surface of the receiver, the head guide having a width configured to accept the lower head of the intermediate locking member;

wherein the receiver defines a neck guide extending inward from the perimeter edge surface of the receiver in communication with the head guide and having a width narrower than the width of the head guide, the neck guide configured to accept the neck of the intermediate locking member; and wherein the head guide and the neck guide collectively form the channel of the receiver.

9. The sport board binding system of claim 1, further comprising a door configured to substantially fill the channel and secure the lower head of the intermediate locking member within the channel.

10. The sport board binding system of claim 9, wherein, when the door substantially fills the channel of the receiver, the receiver and the door collectively define a pocket and a central opening configured such that the pocket houses the lower head of the intermediate locking member with the neck of the intermediate locking member extending through the central opening.

11. The sport board binding system of claim 9, wherein the door includes a locking mechanism to selectively secure the door within the channel.

12. The sport board binding system of claim 1, wherein the intermediate locking member is dumbbell shaped.

13. A sport board binding system, comprising:

a receiver having a bottom surface, a top surface, and a perimeter edge surface between the bottom surface and the top surface, the receiver configured to be secured to a deck of a sport board with the bottom surface of the receiver positioned adjacent to an upper surface of the deck of the sport board, the receiver defining a head guide open at the top surface along substantially the length of the head guide, the head guide extending inward from the perimeter edge surface of the receiver and having a first width, the receiver defining a neck guide extending inward from the perimeter edge surface of the receiver in communication with the head guide and having a second width narrower than the first width of the head guide; and an intermediate locking member having a lower head sized to be positioned within the head guide and connected to an upper head by way of a neck sized to fit within the neck guide;

wherein, when the lower head is positioned within the head guide of the receiver, the neck extends through the neck guide.

14. The sport board binding system of claim 13, further comprising a door configured to substantially fill the head guide and the neck guide to secure the lower head of the intermediate locking member within the head guide.

15. The sport board binding system of claim 14, wherein, when the door substantially fills the head guide and the neck guide, the receiver and the door collectively define a pocket and a central opening configured such that the pocket houses the lower head of the intermediate locking member with the neck of the intermediate locking member extending through the central opening.

16. The sport board binding system of claim 14, wherein the door includes a locking mechanism to selectively secure the door within the head guide and the neck guide.

* * * * *